United States Patent [19]

Sonobe

[11] Patent Number: 4,721,478

[45] Date of Patent: Jan. 26, 1988

[54] WATER SEALED ELECTRICAL CONNECTOR

[75] Inventor: Toshimitsu Sonobe, Tokyo, Japan

[73] Assignee: Thomas & Betts Corporation, Raritan, N.J.

[21] Appl. No.: 896,894

[22] Filed: Aug. 15, 1986

[30] Foreign Application Priority Data

Aug. 23, 1985 [JP] Japan ..... 60-184351
Aug. 23, 1985 [JP] Japan ..... 60-184352

[51] Int. Cl.[4] ..... H01R 13/52

[52] U.S. Cl. ..... 439/278; 439/589; 439/598

[58] Field of Search ..... 339/59–63, 339/94

[56] References Cited

U.S. PATENT DOCUMENTS

| | | | |
|---|---|---|---|
| 2,881,406 | 4/1959 | Arson | 339/59 |
| 2,903,668 | 9/1959 | Cornell, Jr. | 339/63 |
| 3,571,779 | 3/1971 | Collier | 339/18 |
| 4,131,331 | 12/1978 | Kendall, Jr. | 339/126 |
| 4,214,472 | 7/1980 | Maxwell et al. | 439/278 |
| 4,227,762 | 10/1980 | Scheiner | 339/91 |
| 4,311,355 | 1/1982 | Plyler et al. | 339/94 |
| 4,406,507 | 9/1983 | Eifler | 339/59 |
| 4,473,267 | 9/1984 | Sadigh-Behzadi | 339/94 |
| 4,520,423 | 5/1985 | Sutherland | 361/380 |
| 4,556,226 | 12/1985 | Ito | 277/207 |
| 4,560,219 | 12/1985 | Chapelot | 339/60 |
| 4,588,242 | 5/1986 | McDowell et al. | 339/59 |
| 4,611,872 | 9/1986 | Ito et al. | 339/94 |

*Primary Examiner*—Gil Weidenfeld
*Assistant Examiner*—Paula A. Austin
*Attorney, Agent, or Firm*—Robert M. Rodrick; Salvatore J. Abbruzzese

[57] ABSTRACT

A water sealed electrical connector for assembly to a wire terminated by a conductive contact includes an insulative housing having a cavity extending in a front surface thereof and a hole communicating with the cavity and extending into a rear portion of the housing for receipt of the contact. A rubber bush is sealably received in the housing and has a hole in alignment with the housing hole for sealed receipt of the contact. A movable retention member is supported in the housing for latching engagement with the contact. An opening is provided in the housing to permit exterior access to the retention member by a tool, so as to enable the tool to move the retention member for insertion and withdrawal of the contact.

7 Claims, 8 Drawing Figures

WATER SEALED ELECTRICAL CONNECTOR

FIELD OF THE INVENTION

The present invention relates to an electrical connector and more particularly to a connector having a water seal.

BACKGROUND OF THE INVENTION

Electronics technology has been rapidly developed in recent years and its applications have been significantly increased with the advent of compact, high-density electronic components. Thus, printed circuit boards and other devices which incorporate a great number of such electronic components have been utilized in different manners and in various forms.

Connectors for connecting printed circuit boards to each other or connecting a printed circuit board to another electronic component have been also developed in various forms, in accordance with their particular applications.

For example, in connectors of this type for water sealed applications, each of the wires terminated by contacts is typically inserted through a rubber bush, using a special tool, in advance, and the resultant assembly in a sealed state is received within a cavity of a housing. It therefore takes a considerable period of time to assemble the wires in a connector, and more convenient techniques have been needed to accomplish this.

SUMMARY OF THE INVENTION

It is an object of the present invention to provide an improved electrical connector.

It is a further object of the present invention to provide an improved water-sealed electrical connector.

In accordance with a particular form of the invention, a connector for assembly to a wire terminated by a conductive contact comprises an insulative housing having a hole for receipt of the contact therein. A movable retention member is supported by the housing and has a latching portion for latching engagement with the contact for retaining the contact in the hole. An opening extends into the housing and communicates with the retention member. The opening permits entry of a tool therein to engage the movable retention member in such a manner as to move the latching portion away from the contact to thereby allow insertion or withdrawal of the contact from the housing hole. In a more specific form of the invention, a rubber bush is sealably received in the housing, the bush having a hole aligned with the hole in the housing for sealed receipt therein of the contact.

A connector assembly according to the present invention will be described below in detail, with reference to embodiments thereof illustrated in the accompanying drawings.

DETAILED DESCRIPTION OF THE PREFERRED EMBODIMENTS

Figure 1:
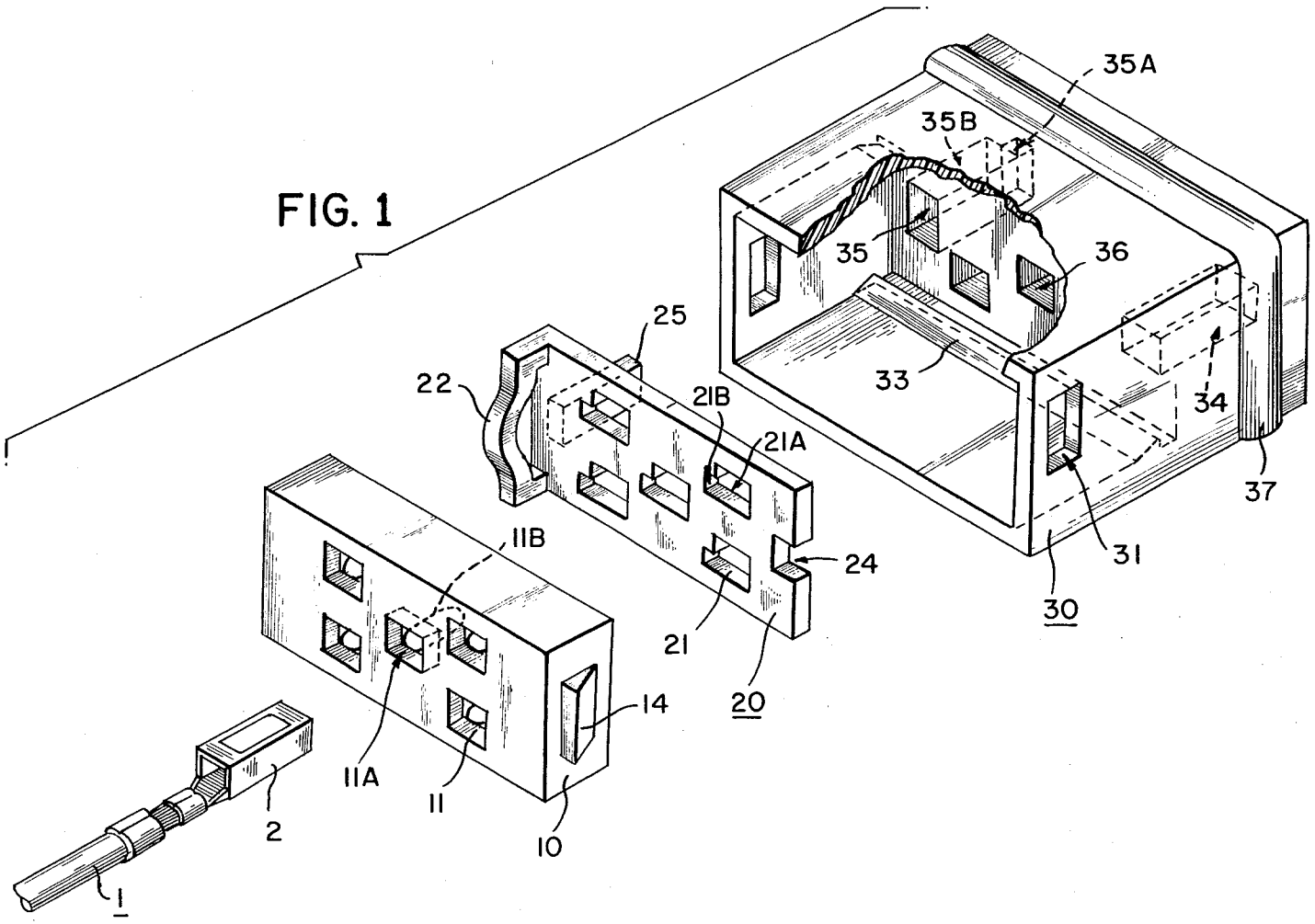
FIG. 1 is an exploded perspective view illustrating a connector assembly according to a particular embodiment of the present invention.

FIG. 1 shows a particular embodiment of the present invention. The connector shown is of the female type and is connected to a tab 41 (see FIG. 6) of a male type connector 40 provided on a printed circuit board 50 in particular use. It is to be noted that the connector assembly according to the present invention is not limited to this structure and may also be formed, for example, by a pair of male and female connectors connected to each other. Since the type of connector (i.e., male or female) is determined in part by the shape of the contact thereof and is not essential, the present invention can be applied to connector assemblies of either type.

In FIG. 1, reference numeral 1 denotes an electrical wire which is terminated by a conductive contact 2. Typically, a cylindrical contact having a rectangular cross-section is used, but the present invention is not limited to this configuration, as previously described.

Figure 2:
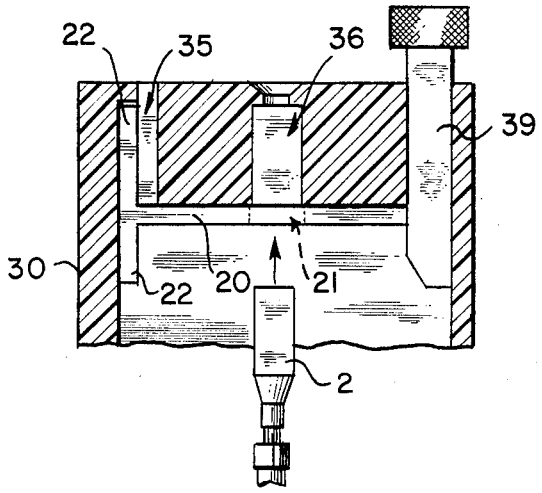
FIGS. 2 and 3 are respectively fragmented cross-sectional views illustrating an assembly procedure employed in the embodiment of FIG. 1.
Figure 3:
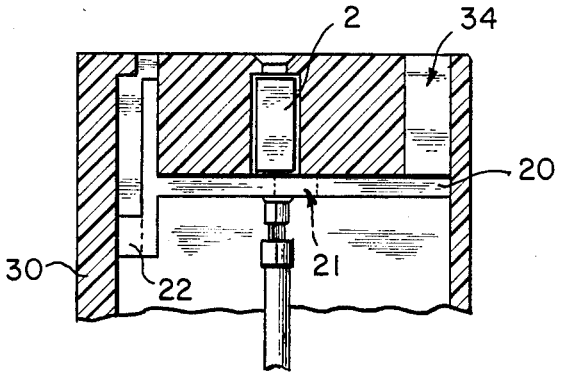
Figure 6:
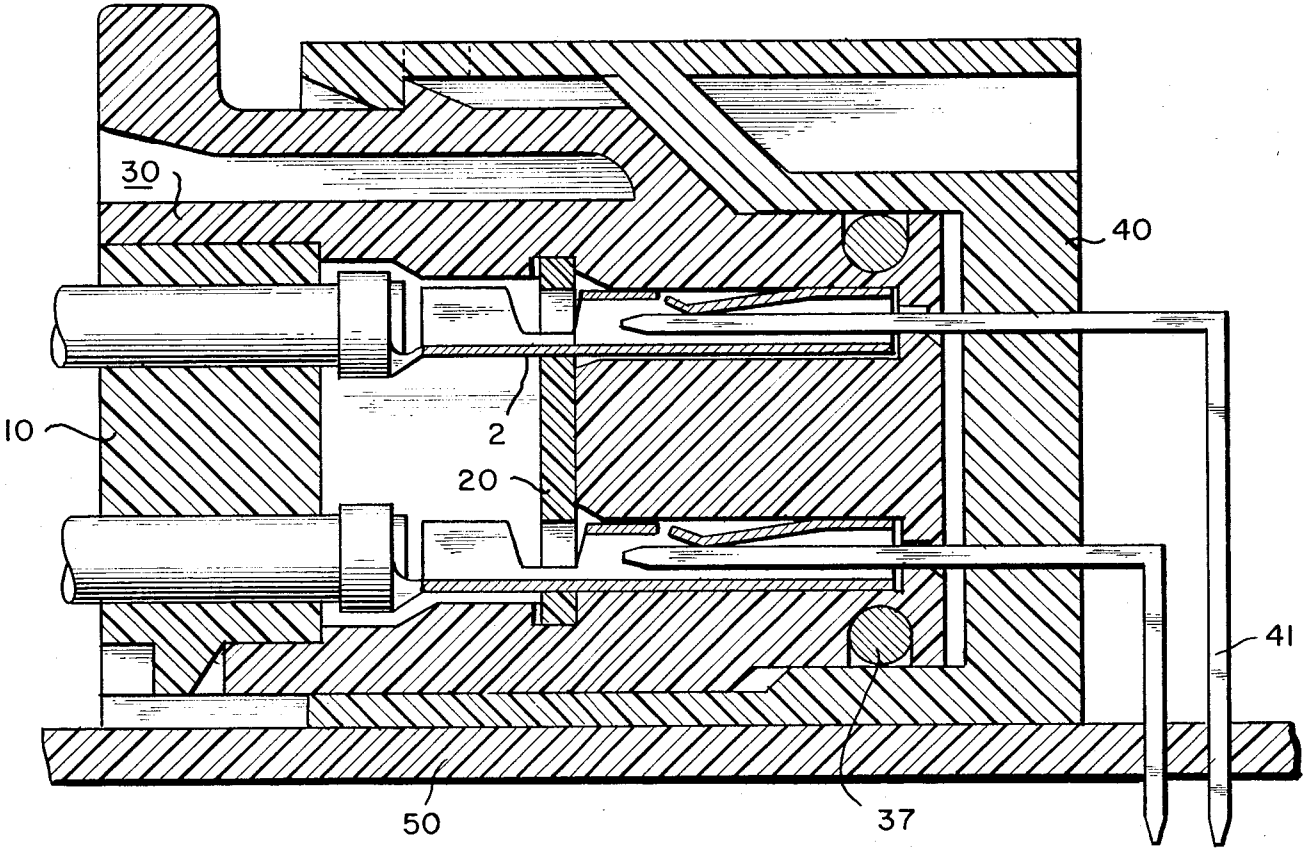
FIG. 6 is a longitudinal sectional view illustrating an example of a particular application of the embodiment shown in FIG. 1.

Reference numeral 30 denotes an insulative housing which has a cavity for receiving a rubber bush to be described later and a holding plate 20. A hole 36 is provided for receiving the contact 2 which is passed through the rubber bush and the holding plate. The contact is received in the hole in the manner as shown in FIGS. 2, 3 and 6 to be described hereinafter.

Reference numeral 10 denotes a rubber bush having hole portions 11 through each of which the wire 1 passes. Each hole portion includes a recess 11A provided in one surface of the rubber bush, and a through hole 11B which extends from the bottom of the recess to the other surface of the rubber bush. The recess is preferably provided with an opening of the shape corresponding to that of the cross-section of the above-mentioned contact.

The contact which terminates the wire is first inserted into the recess of the rubber bush, and is then passed through and expands the through hole. At this point, the orientation of the contact is determined since the shape of the recess opening corresponds to that of the cross-section of the contact. In addition, the respective wires are sealed by the through holes of the hole portions.

The rubber bush is sealably fixed within the cavity of the housing by fixing means, which is exemplified by an engaging projection 14 formed on the rubber bush, and an engaging grove 31 formed in the housing.

Reference numeral 20 denotes the holding plate having hole portions 21 through each of which the contacts 2 of the terminated wire are passed subsequent to passing through the rubber bush.

The hole portion 21 of the holding plate is integrally formed by a portion through which the contact is inserted and a portion with which the conductive contact 2 is latchably engaged. More particularly, each hole portion includes a first through hole 21A having an opening of such size that the contact can be inserted therethrough, and a second through hole 21B having an opening smaller than that of the first through hole.

The contact of each wire is inserted through the first through hole (in the embodiment shown, the contact is received in the hole 36, which communicates with the exterior of the housing from the bottom of the cavity, after it passes through the holding plate) and the holding plate is then slidably displaced. This causes the junction between the contact and the wire to be engaged in the second through hole (see FIGS. 2 through 5).

In the embodiment shown in FIG. 1, a spring member 22 is provided, for example, at one side edge of the holding plate so that the plate can be locked in the housing. This spring member locks the holding plate by urging it against the inner wall of the housing opposite the spring member within the cavity of the housing.

Figure 8:
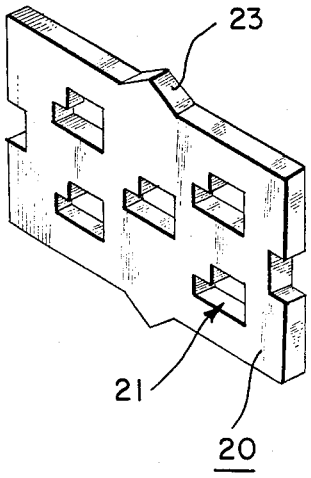
FIG. 8 is a perspective view illustrating a further embodiment of the holding plate according to the present invention.

This locking means may also be realized by a latch 23, as shown in FIG. 8, provided on one side edge of the holding plate and a corresponding notch provided in the inner wall of the housing.

In order to render the holding plate slidably movable after it has been temporarily locked by the above-mentioned locking means, a tool 39 (see FIG. 2) for moving the holding plate is inserted into a through hole 34 having exterior access provided in the housing, and a notch 24 provided at one side edge of the plate is engaged with the tool to displace the plate (see FIG. 2).

The holding plate may also be displaced by other means. For example, the circumferential side surface of the above-mentioned contact may be formed as a cam surface, so that the holding plate is displaced as the contact is inserted into the through hole of the holding plate.

The displacement of the above-mentioned holding plate is indicated, for example, by bringing a pole 25 which is made to project from the holding plate into alignment with an indicator hole 35 formed in the housing. The indicator hole consists of a through hole portion 35A and a blind hole portion 35B. As the holding plate is displaced, the pole moves into the blind hole portion and thereby becomes invisible from outside. This allows the movement of the plate to be identified from the outside.

In FIG. 1, reference numeral 33 denotes means for displacing the holding plate only in a predetermined direction within the housing. More specifically, this means comprises a stopper for preventing the movement of the holding plate in any direction which crosses the direction along the surface of the plate.

FIGS. 2 and 3 show the procedure according to which the contact is engaged with the holding plate and is received in the contact holding hole 36 in the housing in the first embodiment of the present invention shown in FIG. 1.

As shown in FIG. 2, a tool 39 for moving the holding plate is first inserted into the through hole 34 provided in the housing for allowing the tool to pass therethrough. Next, the tool is engaged with the notch 24 provided at the side edge of the holding plate, to slide the plate.

At this point, since the first through hole 21A of the holding plate is aligned with the hole 36 of the housing, the contact extends through hole 21A.

When the tool 35 is withdrawn, the spring member of the holding plate acts to return the holding plate to its initial position, as shown in FIG. 3. The junction between the contact and the wire is engaged in the second through hole 21B in the holding plate, which thereby holds the contact received in the housing. Release of the contact is similarly effected by movement of the holding plate by the tool 39 in the same manner as effecting insertion.

Figure 4:
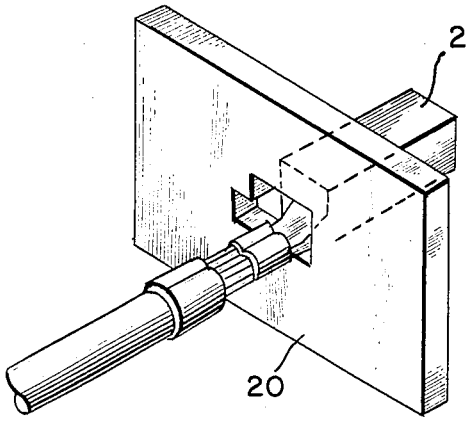
FIGS. 4 and 5 are respectively perspective views illustrating various components in the assembly procedure shown in FIGS. 2 and 3.
Figure 5:
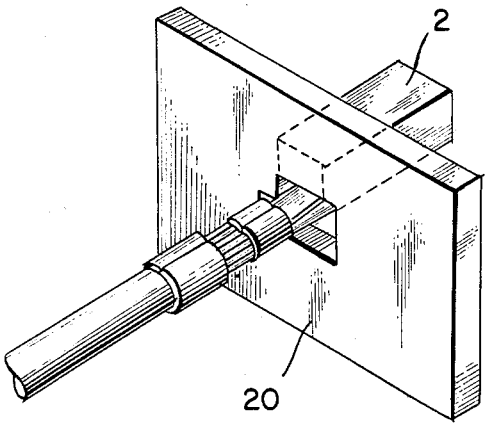

FIGS. 4 and 5 show a state wherein the contact 2 of the wire is engaged with the holding plate. More particularly, FIG. 4 shows a state wherein the contact is inserted through the first through hole 21A of the hole portion, while FIG. 5 shows a state wherein the holding plate is displaced (slid) to bring the junction (the constricted portion) between the wire and the contact into engagement in the second through hole 21B of the hole portion.

FIG. 6 is a longitudinal sectional view illustrating a connector assembly, according to the present invention, which is connected with a male type connector provided on a printed circuit board.

In this drawing figure, reference numeral 50 denotes a printed circuit board; 41, a tab-like terminal (contact); 40, a housing of the male type connector; and 37, a waterproof O-ring.

The connector assembly according to the present invention is used as a female type connector in this case.

The construction of the connector assembly according to the present invention has been described above and provides the following desirable advantages.

In the connector according to the present invention, the contact at the terminated end of the wire can be inserted through the rubber bush without using a special tool. In addition, the fixed direction of insertion can be maintained by matching the shape of a noncircular contact with that of the recess of the rubber bush, and the wire passed through the rubber bush is sufficiently sealed by the through hole, which communicates with the above-mentioned recess.

With the holding plate according to the present invention, the contacts at the ends of the wires are respectively inserted or released through the hole portions of the holding plate when the plate is slid by a tool. The contacts are then engaged with and held in the plate upon removal of the tool. This results in significant improvement in the efficiency of the assembly operation.

The present invention can be widely applied. For example, since the contact of the present invention is formed in a particular arrangement as a cylindrical contact having a rectangular cross-section, it can be connected with a flat tab terminal (contact) provided on a printed circuit board.

Figure 7:
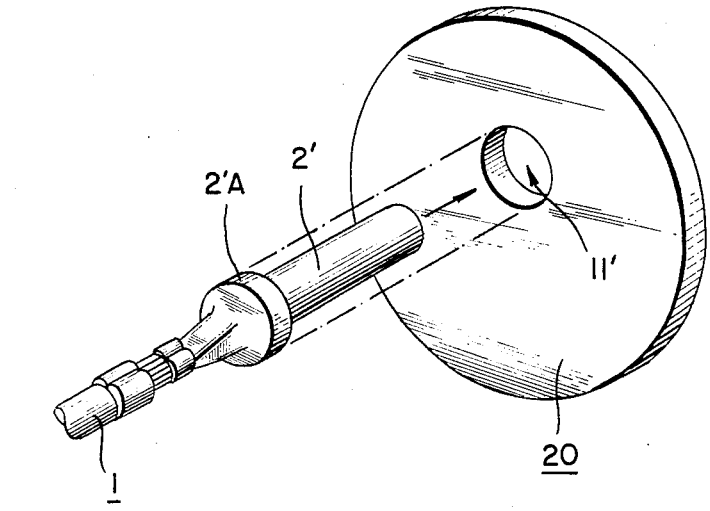
FIG. 7 is a perspective view illustrating another embodiment of the holding plate according to the present invention.

Having described the preferred embodiment of the present invention it should be appreciated that variations may be made without departing from the contemplated scope of the invention. For example, as shown in FIG. 7 the plate shown may be disk-shaped (therefore, the housing for receiving this plate has a cavity with a similar circular opening). A contact 2' of each wire is first inserted through a hole portion 11' of this plate. Since the contact has a flange 2'A, the hole portion has a diameter which allows this flange to pass therethrough. After each wire is inserted through the through hole in the plate shown, the plate is pivoted to bring each wire into engagement with one of the hole portions in the plate. As such, the embodiments described herein are intended to be illustrative rather than limiting, the true scope of the invention being set forth in the claims appended hereto.

I claim:

1. A connector assembly to a wire terminated by a conductive contact, comprising:

an insulative housing (30) having a cavity extending into a front surface thereof and a hole (36) communicating with said cavity and extending into a rear portion of said housing for receipt of said contact;

sealing means (37) extending exteriorly on the housing around its rear portion for providing a seal when said housing (30) is inserted into a connector header (40);

a rubber bush 10 sealably received in said housing cavity and having a hole (11) aligned with said hole (36) in said housing for sealed receipt of said contact;

a movable retention member (20) supported by said housing adjacent said hole (36) in said housing and having a latching portion (21B) for latching engagement with said contact for retaining said contact in said hole (36); and an opening (34) extending into said housing through said rear portion thereof and communicating with said retention member to permit the entry of a tool to engage said movable retention member so as to move said latching portion away from the latching position and thereby allow withdrawal of said contact from said housing hole.

2. A connector according to claim 1, wherein said opening (34) is provided through a rear surface of said housing.

3. A connector according to claim 1 wherein said retention member includes a surface for engagement with a cam face on said conductive contact, said cam face causing thereby said retention member to displace when said conductive contact is brought into engagement therewith.

4. A connector according to claim 1, wherein said retention member comprises a movable plate (20) having a hole (21) for inserting therethrough said conductive contact.

5. A connector according to claim 4 wherein the hole (21) of said retention plate comprises a first hole portion (21A) having an opening capable of inserting the conductive contact therein, and a second hole portion (21B) having another opening smaller than the opening of said first hole portion and defining said latching portion for engaging the conductive contact of said wire therewith.

6. A connector for assembly to a wire terminated by a conductive contact, comprising:

an insulative housing (30) having a cavity extending into a front surface thereof and a hole (36) communicating with said cavity and extending into a rear portion of said housing for receipt of said contact;

a rubber bush (10) sealably received in said housing cavity and having a hole (11) aligned with said hole (36) in said housing for sealed receipt of said contact;

securement means (14, 31) for sealably securing said rubber bush in said housing cavity;

a movable retention member (20) supported by said housing adjacent said hole (36) in said housing and having a latching portion (21B) for latching engagement with said contact for retaining said contact in said hole (36); and an opening (34) extending into said housing through said rear portion thereof and communicating with said retention member to permit the entry of a tool to engage said movable retention member so as to move said latching portion away from the latching position and thereby allow withdrawal of said contact from said housing hole.

7. A connector according to claim 6, further including sealing means (37) extending exteriorly on the housing around its rear portion for providing a seal when said housing 30 is inserted into connector header 40.

* * * * *